United States Patent [19]
Montgomery, Jr.
[11] 3,961,576
[45] June 8, 1976

[54] REACTIVE FRAGMENT

[76] Inventor: Hugh E. Montgomery, Jr., 209 N. Randolph Road, Fredericksburg, Va. 22401

[22] Filed: June 25, 1973

[21] Appl. No.: 375,246

[52] U.S. Cl. ..... 102/67; 102/6; 102/65; 102/66; 102/90
[51] Int. Cl.$^2$ ..... F42B 13/48
[58] Field of Search ..... 102/6, 90, 66, 65, 67, 102/68, 40

[56] References Cited

UNITED STATES PATENTS

| | | | |
|---|---|---|---|
| 2,586,801 | 2/1952 | Epler et al. | 102/6 |
| 2,869,463 | 1/1959 | McKnight | 102/40 X |
| 3,254,996 | 6/1966 | MacDonald | 102/6 |
| 3,489,088 | 1/1970 | Von Ballmoos et al. | 102/68 X |
| 3,669,020 | 6/1972 | Waite et al. | 102/6 |

*Primary Examiner*—Verlin R. Pendegrass

[57] ABSTRACT

A fragment for an ordnance item having a blind recess within which are disposed a number of layers or pellets of thermite ($Al\text{-}Fe_2O_3$) or a thermite-like metal-metal oxide mixture; the density of each layer being successively less than the layer beneath it, proceeding from bottom to top of the blind recess, due to the use of diminishing compacting pressures. The density of the top layer is such that it will ignite due to the heat and shock of explosive projection upon detonation of the ordnance item and produce the following reaction: $2Al + Fe_2O_3 \rightarrow Al_2O_3 + 2Fe$. Since the burning rate of the layers varies inversely with their density, a substantial portion of the thermite will remain unreacted over a considerable range until the fragment impacts with a target at which time the remaining chemical energy of the thermite will be explosively released.

6 Claims, 1 Drawing Figure

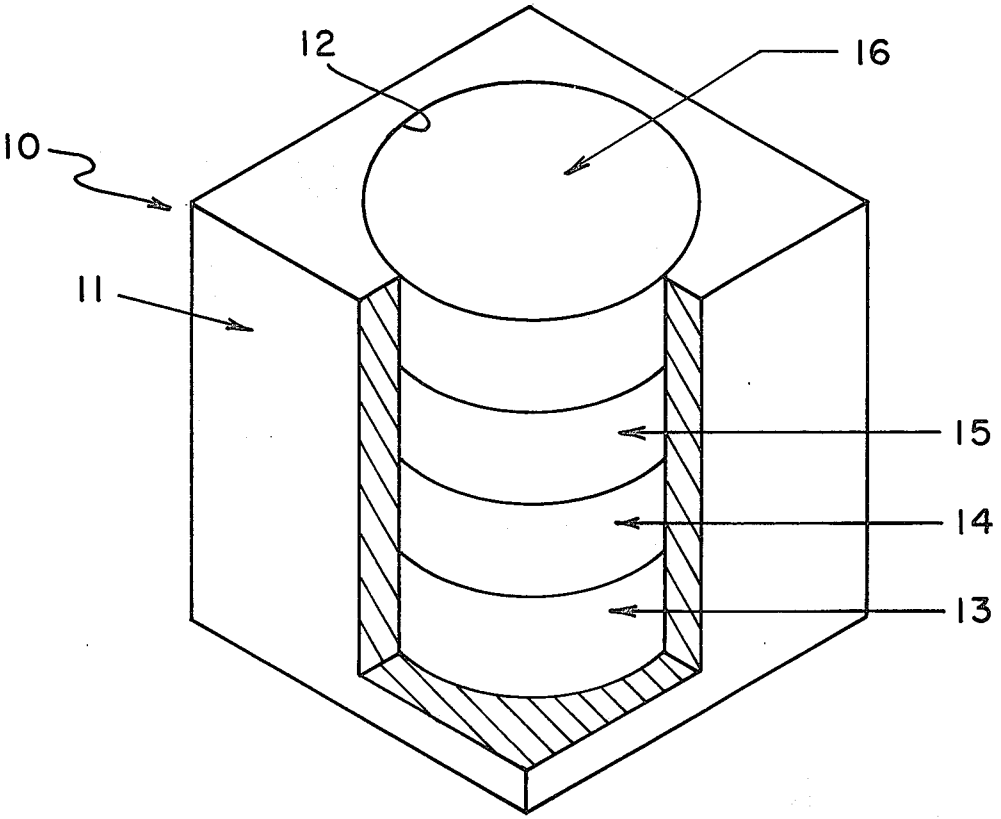
10
11
12
16
15
14
13

REACTIVE FRAGMENT

BACKGROUND OF THE INVENTION

1. Field of the Invention

This invention relates generally to fragments for ordnance items and more particularly to a reactive fragment adapted to release both chemical and mechanical energy upon impact with the target. ordnance 2. Description of the Prior Art The three primary parameters which can be manipulated to improve the performance of conventional warheads are (1) Explosive efficiency, (2) Warhead geometry, and (3) Kill mechanism. Of these parameters, it is the third, Kill mechanism, which appears at the present time to offer the greatest potential for upgrading warhead performance. In the past, considerable ingenuity has been directed toward designs which will control fragment size for warheads and other ordance items. Against soft targets, such as aircraft, trucks and electronic equipment, conventional fragments can easily pass through the target with no damage beyond entrance and exit perforations. In fact, in such an encounter, only a small percentage of a fragment momentum is transmitted to the target. Steel fragments have been demonstrated to produce blast-type damage only at very high impact velocity (above 10,000 feet/sec.). Since conventional warheads produce fragment velocities in the range of 2,000 to 6,000 feet/sec., this type of blast damage is not readily available with conventional fragments.

SUMMARY OF THE INVENTION

The present invention provides a metal-metal oxide (i.e. thermite-type) reactive fragment for which in-flight burning rate, and thus maximum range can be controlled. Thermite-type reactive fragments have been demonstrated to produce significant blast-type destruction of light targets due to the rapid release of chemical and mechanical energy upon impact. In addition, they have incendiary capabilities far beyond that of conventional fragmentation. The present invention provides a recessed fragment into which a plurality of layers of thermite have been pressed with diminishing pressures so that the burning rate of the thermite varies inversely with the depth within the recess. The surface layer of thermite begins to burn at warhead initiation, but the burn rate decreases as the reaction front reaches the inner layers. Upon impact with the target, the case ruptures and the remaining reactive mixture burns violently. The maximum desired range of the fragment is controlled by the various pressing pressures of the layers.

OBJECTS OF THE INVENTION

It is a primary object of the invention to provide a reactive fragment for an ordnance item which releases both chemical and mechanical energy upon impact with the target.

It is another object of this invention to provide a reactive fragment for an ordnance item which produces blast-type damage upon striking a target.

It is a further object of this invention to provide a reactive fragment for an ordnance item, the maximum desired range of which may be controlled during manufacture.

It is yet another object of this invention to provide a reactive fragment for an ordnance item which has a greatly enhanced incendiary capability.

BRIEF DESCRIPTION OF THE DRAWING

The sngle FIGURE of the drawing, partially in section, illustrates a reactive fragment made in accordance with the principles of the present invention.

DESCRIPTION OF THE PREFERRED EMBODIMENT

Attention now is directed to the drawing wherein there is disclosed the reactive fragment of the present invention, designated generally by the reference numeral 10, and comprising a case or body 11, preferably of aluminum, having a blind recess 12 formed therein. Disposed within the recess 12 are layers or pellets of thermite (or other reactive metal-metal oxide mixture) 13, 14, 15, and 16.

Because thermite-type materials are produced in the form of powders, it is necessary to pelletize the powders for ease in handling. This is accomplished by hydrate bonding under cold pressure. Thermite powder is mixed with water to form a slurry and pressed at high pressure. The resulting pellet is then air-dried for one hour and cured in water at room temperature for at least 24 hours. During curing the following reaction occurs:

$$2Al + 6H_2O \rightarrow 2Al(OH)_3 + 3H_2$$

until a thin shell of $Al(OH)_3$ forms about the pellet. The initial proportions of Al and $Fe_2O_3$ are selected so that upon completion of the foregoing reaction, the remaining Al and $Fe_2O_3$ forms a substantially stoichiometric mixture. This results in a cement-like pellet with good compressive strength which is quite brittle.

It has been experimentally determined that thermite fragments produced by the above process have a burning rate which varies with the pressure at which they are pressed. If the compacting pressure were below 75,000 p.s.i., the material reacts too quickly and is consumed in the explosive fireball produced by warhead detonation. On the other hand, if the compacting pressure were above 130,000 p.s.i., the fragment becomes inert and will not react from explosive shock. Within this pressure range, the fragments will travel over a maximum stand-off of 20 feet before the incendiary material is consumed, which is an unacceptable stand-off capability for proposed warhead usage.

Although pellets pressed at pressures of 130,000 p.s.i. will not ignite from the heat and shock of explosive projection they have been shown to be ignited by other burning thermite. Since the burning rate varies inversely with pressing pressure, the fragment range can be extended by pressing an inner layer at 130,000 p.s.i. or greater and one or more outer layers at lower (ignitable) pressures.

Referring again to the drawing, the inner layer 13 would be pressed at a very high pressure and the intermediate layers 14 and 15 at successively diminishing pressures. The outer layer 16, in the case of thermite, would be pressed at a pressure which falls within the region of proper reaction (75,000 to 125,000 p.s.i.). The pressure range is thus adjusted so the fragment begins to burn at warhead initiation, but the burning rate decreases as the reaction front reaches the inner layers. Upon impact with the target the aluminum case ruptures and the remaining reactive mix burns violently. The maximum desired range of the fragment is controlled by the various pressing pressures of the layers.

Some of the advantages of reactive fragments were discussed above in general in the summary of the invention. Certain additional advantages of the layered fragment design which will be immediately apparent to those skilled in the art as follows:

1. The maximum range of the fragment may be extended to the standoffs expected in surface to air missile encounters;

2. The high pressing pressures of the inner layers leads to a more dense fragment than normal, resulting in more potential energy in a given size fragment; and 3. The fragment range can be tailored to an application in which fragmentation is not desired to extend past a certain critical standoff.

Also, certain possible variations or modifications of the invention which would immediately occur to those skilled in the art which include the following:

1. Another similar metal-metal oxide or metal-metal reactant canb be used in place of thermite, e.g. Mg + CuO, 2Al + 3CuO, 8Al + 3$Co_3O_4$, 2Mg + $PbO_2$, 8 Al + 3$Pb_3O_4$ and Pyronol (Ni-Al mix);

2. The fragment can be pressed with an inner core of one material and an outer layer of another;

3. An outer layer of high compacting pressure with a sensitizer added can be used in lieu of a lower compacting pressure layer;

4. The fragment size can be changed to correspond to varying ordnance requirements; and 5. A reactive metal can be used as a casing material.

Obviously, many other modifications and variations of the present invention are possible in the light of the above teachings. It is therefore to be understood that within the scope of the appended claims the invention may be practiced otherwise than as specifically described.

What is claimed is:

1. A reactive fragment for an ordnance item adopted to release both chemical and mechanical energy upon impact with a target comprising:

a fragment body having a blind recess formed therein; and a plurality of layers of a chemically reactive material comprising a metal-metal oxide mixture disposed within said blind recess in said fragment body, said layers being of successively diminishing density and increasing reaction rate from bottom to top of said recess, the top layer being of a density such that it will ignite due to the heat and shock of explosive projection upon detonation of the ordnance item, and at least the bottom layer having been consolidated at a pressure greater than 130,000 pounds per square inch.

2. A reactive fragment a defined in claim 1 wherein the metal and metal-oxide of said chemically reactive material are combined in a stoichiometric mixture.

3. A reactive fragment as defined in claim 1 wherein said fragment body is formed of aluminum.

4. A reactive fragment as defined in claim 1 wherein said chemically reactive material comprises a mixture of ferric oxide and aluminum.

5. A reactive fragment as defined in claim 2 wherein said chemically reactive material comprises a mixture of ferric oxide and aluminum.

6. A reactive fragment as defined in claim 3 wherein said chemically reactive material comprises a mixture of ferric oxide and aluminum.

* * * * *